US006201353B1

(12) United States Patent
Chang et al.

(10) Patent No.: US 6,201,353 B1
(45) Date of Patent: Mar. 13, 2001

(54) LED ARRAY EMPLOYING A LATTICE RELATIONSHIP

(75) Inventors: Chin Chang; Shaomin Peng, both of Yorktown Heights, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/431,585

(22) Filed: Nov. 1, 1999

(51) Int. Cl.[7] ..... H05B 37/00

(52) U.S. Cl. ..... 315/185 S; 315/185 R; 362/252; 362/800

(58) Field of Search ..... 315/185 R, 185 S, 315/179, 192, 312, 324, 200 A; 362/800, 252

(56) References Cited

U.S. PATENT DOCUMENTS 3,619,715 * 11/1971 Kim ..... 315/232
4,329,625 * 5/1982 Nishizawa et al. ..... 315/192
5,490,049 2/1996 Montalan et al. ..... 362/240
5,806,965 * 9/1998 Deese ..... 362/800

* cited by examiner

*Primary Examiner*—Don Wong
*Assistant Examiner*—Wilson Lee
(74) *Attorney, Agent, or Firm*—Robert J. Kraus

(57) ABSTRACT

A lighting system comprising a plurality of light-emitting diodes and a current driver for driving current through a plurality of parallel disposed, electrically conductive branches, wherein the branches comprise at least one cell. In each cell, each branch has a light-emitting diode with an anode terminal and a cathode terminal. The anode terminal of each light-emitting diode is coupled to the cathode terminal of a light-emitting diode of an adjacent branch via a shunt. The shunt further comprises a light-emitting diode. A set of corresponding light-emitting diodes together with the shunt couplings define a cell. The branches along with the shunts are coupled in a specifiable lattice arrangement.

24 Claims, 6 Drawing Sheets

LED ARRAY EMPLOYING A LATTICE RELATIONSHIP

FIELD OF THE INVENTION

This invention relates generally to lighting systems, and more particularly to an improved array for light-emitting diodes used as illumination sources.

BACKGROUND OF THE INVENTION

A light-emitting diode (LED) is a type of semiconductor device, specifically a p-n junction, which emits electromagnetic radiation upon the introduction of current thereto. Typically, a light-emitting diode comprises a semiconducting material that is a suitably chosen gallium-arsenic-phosphorus compound. By varying the ratio of phosphorus to arsenic, the wavelength of the light emitted by a light-emitting diode can be adjusted.

With the advancement of semiconductor materials and optics technology, light-emitting diodes are increasingly being used for illumination purposes. For instance, high brightness light-emitting diodes are currently being used in automotive signals, traffic lights and signs, large area displays, etc. In most of these applications, multiple light-emitting diodes are connected in an array structure so as to produce a high amount of lumens.

FIG. 1 illustrates a typical arrangement of light-emitting diodes 1 through m connected in series. Power supply source 4 delivers a high voltage signal to the light-emitting diodes via resistor $R_1$, which controls the flow of current signal in the diodes. Light-emitting diodes which are connected in this fashion usually lead to a power supply source with a high level of efficiency and a low amount of thermal stresses.

Occasionally, a light-emitting diode may fail. The failure of a light-emitting diode may be either an open-circuit failure or a short-circuit failure. For instance, in short-circuit failure mode, light-emitting diode 2 acts as a short-circuit, allowing current to travel from light-emitting diode 1 to 3 through light-emitting diode 2 without generating a light. On the other hand, in open-circuit failure mode, light-emitting diode 2 acts as an open circuit, and as such causes the entire array illustrated in FIG. 1 to extinguish.

In order to address this situation, other arrangements of light-emitting diodes have been proposed. For instance, FIG. 2(*a*) illustrates another typical arrangement of light-emitting diodes which consists of multiple branches of light-emitting diodes such as 10, 20, 30 and 40 connected in parallel. Each branch comprises light-emitting diodes connected in series. For instance, branch 10 comprises light-emitting diodes 11 through $n_1$ connected in series. Power supply source 14 provides a current signal to the light-emitting diodes via resistor $R_2$.

Light-emitting diodes which are connected in this fashion have a higher level of reliability than light-emitting diodes which are connected according to the arrangement shown in FIG. 1. In open-circuit failure mode, the failure of a light-emitting diode in one branch causes all of the light-emitting diodes in that branch to extinguish, without significantly affecting the light-emitting diodes in the remaining branches. However, the fact that all of the light-emitting diodes in a particular branch are extinguished by an open-circuit failure of a single light-emitting diode is still an undesirable result. In short-circuit failure mode, the failure of a light-emitting diode in a first branch may cause that branch to have a higher current flow, as compared to the other branches. The increased current flow through a single branch may cause it to be illuminated at a different level than the light-emitting diodes in the remaining branches, which is also an undesirable result.

Still other arrangements of light-emitting diodes have been proposed in order to remedy this problem. For instance, FIG. 2(*b*) illustrates another typical arrangement of light-emitting diodes, as employed by a lighting system of the prior art. As in the arrangement shown in FIG. 2(*a*), FIG. 2(*b*) illustrates four branches of light-emitting diodes such as 50, 60, 70 and 80 connected in parallel. Each branch further comprises light-emitting diodes connected in series. For instance, branch 50 comprises light-emitting diodes 51 through $n_5$ connected in series. Power supply source 54 provides current signals to the light-emitting diodes via resistor $R_3$.

The arrangement shown in FIG. 2(*b*) further comprises shunts between adjacent branches of light-emitting diodes. For instance, shunt 55 is connected between light-emitting diodes 51 and 52 of branch 50 and between light-emitting diodes 61 and 62 of branch 60. Similarly, shunt 75 is connected between light-emitting diodes 71 and 72 of branch 70 and between light-emitting diodes 81 and 82 of branch 80.

Light-emitting diodes which are connected in this fashion have a still higher level of reliability than light-emitting diodes which are connected according to the arrangements shown in either FIGS. 1 or 2(*a*). This follows because, in an open-circuit failure mode, an entire branch does not extinguish because of the failure of a single light-emitting diode in that branch. Instead, current flows via the shunts to bypass a failed light-emitting diode.

In the short-circuit failure mode, a light-emitting diode which fails has no voltage across it, thereby causing all of the current to flow through the branch having the failed light-emitting diode. For example, if light-emitting diode 51 short circuits, current will flow through the upper branch. Thus, in the arrangement shown in FIG. 2(*b*), when a single light-emitting diode short circuits, the corresponding light-emitting diodes 61, 71 and 81 in each of the other branches are also extinguished.

The arrangement shown in FIG. 2(*b*) also experiences other problems. For instance, in order to insure that all of the light-emitting diodes in the arrangement have the same brightness, the arrangement requires that parallel connected light-emitting diodes have matched forward voltage characteristics. For instance, light-emitting diodes 51, 61, 71 and 81, which are parallel connected, must have tightly matched forward voltage characteristics. Otherwise, the current signal flow through the light-emitting diodes will vary, resulting in the light-emitting diodes having dissimilar brightness.

In order to avoid this problem of varying brightness, the forward voltage characteristics of each light-emitting diode must be tested prior to its usage. In addition, sets of light-emitting diodes with similar voltage characteristics must be binned into tightly grouped sets (i.e—sets of light-emitting diodes for which the forward voltage characteristics are nearly identical). The tightly grouped sets of light-emitting diodes must then be installed in a light-emitting diode arrangement parallel to each other. This binning process is costly, time-consuming and inefficient.

Various light-emitting diode arrangements were proposed in Applicant's co-pending applications, designated as Attorney Docket Numbers 755-003 and 755-004, both of which are incorporated herein by reference as fully as if set forth in their entirety. However, there exists a further need for an improved light-emitting diode arrangement which does not suffer from the problems of the prior art.

SUMMARY OF THE INVENTION

In accordance with one embodiment of the present invention, a lighting system comprises a plurality of light-emitting diodes. The lighting system further comprises a power supply source for driving a current signal through a plurality of parallel disposed, electrically conductive branches. Each light-emitting diode in one branch together with corresponding light-emitting diodes in the remaining branches define a cell unit. In each cell, the anode terminal of each light-emitting diode in one branch is coupled to the cathode terminal of a corresponding light-emitting diode of an adjacent branch via a shunt. Each shunt further comprises another light-emitting diode. The branches along with the shunts are coupled in a lattice arrangement.

According to one embodiment, a plurality of K cells are coupled together in a cascading arrangement. In each cell, the shunts couple an anode terminal of a first light-emitting diode to a cathode terminal of a light-emitting diode which is $2^n$ branches away, wherein n defines the cell sequence, and ranges from n=1 to n=K. In another embodiment, the shunts couple an anode terminal of a first light-emitting diode to a cathode terminal of a light-emitting diode which is $2^{N-1}$ branches away, while in still another embodiment, the shunts couple an anode terminal of a first light-emitting diode to a cathode terminal of a light-emitting diode which is $2^{N-n}$ branches away from said first light-emitting diode.

In another embodiment, each cell comprises N input node terminals and N output node terminals. Accordingly, in each cell, each input node terminal in an upper half of the structure, along with a corresponding input node terminal in the lower half of the structure, are connected to the same output node terminals. Alternatively, in each cell, each output node terminal in an upper half of the structure, along with a corresponding output node terminal in the lower half of the structure, are connected to the same input node terminals.

The arrangement of light-emitting diodes according to the present invention enables the use of light-emitting diodes having different forward voltage characteristics, while still insuring that all of the light-emitting diodes in the arrangement have substantially the same brightness. Advantageously, the lighting system of the present invention is configured such that, upon failure of one light-emitting diode in a branch, the remaining light-emitting diodes in that branch are not extinguished.

In a preferred embodiment, each branch of the lighting system includes a current-regulating element, such as a resistor, coupled for example, as the first and the last element in each branch.

BRIEF DESCRIPTION OF THE DRAWINGS

The present invention will be further understood from the following description with reference to the accompanying drawings, in which:

FIG. 2(*b*) illustrates another typical arrangement of light-emitting diodes, as employed by a lighting system of the prior art;

DETAILED DESCRIPTION OF THE INVENTION

Generally, the light-emitting diode arrangements of the present invention, according to various embodiments (some of which are illustrated in FIGS. 3 through 7, and which are discussed in detail below), connect light-emitting diodes in configurations which are governed by a lattice relationship. The circuits shown in FIGS. 3 through 7 illustrate some of the ways that light-emitting diodes can be connected according to various configurations, but the invention is not intended to be limited in scope by the configurations illustrated.

FIG. 3

Figure 3:
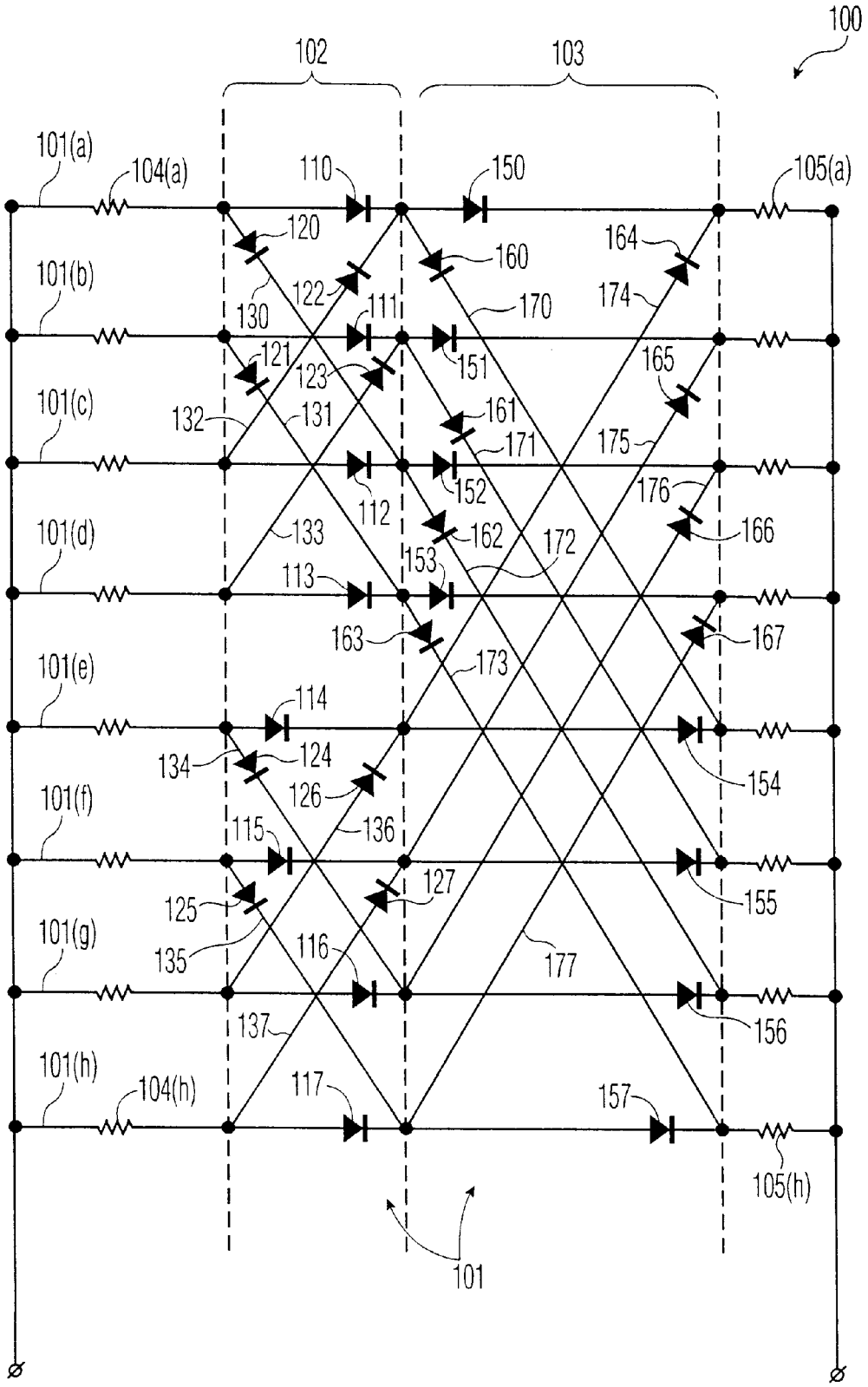
FIG. 3 illustrates an arrangement of light-emitting diodes, as employed by a lighting system, according to one embodiment of the present invention.

FIG. 3 illustrates an arrangement 100 of light-emitting diodes, as employed by a lighting system, according to one embodiment of the present invention. The lighting system comprises a plurality of electrically-conductive branches. Each cell 101 of arrangement 100 comprises N branches. In the embodiment shown, N=8, and thus arrangement 100 comprises 8 branches, designated as branches 101(*a*) through 101(*h*). However, the present invention is not intended to be limited in scope by the number of branches this arrangement, or any of the other arrangements described below.

Each branch has light-emitting diodes which are connected in series. A set of corresponding light-emitting diodes of all branches (together with light-emitting diodes of coupling shunts therebetween, which are described in detail below) define a cell. The arrangement shown in FIG. 3 illustrates cascading cells 102 and 103 of light-emitting diodes. It is noted that, in accordance with various embodiments of the present invention, K number of cells may be formed, wherein K is an integer.

Each cell 101 of arrangement 100 comprises a first light-emitting diode (such as light-emitting diode 110) of branch 101(*a*), a first light-emitting diode (such as light-emitting diode 111) of branch 101(*b*), etc. through a first light-emitting diode (such as light-emitting diode 117) of branch 101(*h*). Each of the branches having the light-emitting diodes are initially (i.e.—before the first cell) coupled in parallel via resistors (such as resistors 104(*a*) through 104(*h*). The resistors preferably have the same resistive values, to insure that an equal amount of current is received via each branch.

The anode terminal of the light-emitting diode in each branch is coupled to the cathode terminal of a corresponding light-emitting diode in a different branch. This connection is made by a shunt which, according to one embodiment, comprises another light-emitting diode. Depending on the cell, the shunt is connected from a first branch to a second branch, wherein the second branch is a specifiable number of branches away from the first branch. In the embodiment illustrated in FIG. 3, each shunt is connected to the anode terminal of a light-emitting diode in a first branch and to the cathode terminal of a light-emitting diode in a second branch, wherein the second branch is $2^n$ branches away from the first branch and n is the cell number, ranging from 1 to K.

Thus, in the first cell (n=1), each shunt is connected to the anode terminal of a light-emitting diode in a first branch and to the cathode terminal of a light-emitting diode in a second branch, wherein the second branch is $2^1$, or 2, branches away from the first branch. For instance, in cell 102 of the arrangement illustrated by FIG. 3 (cell 102 is the first cell, therefore n=1), the anode terminal of light-emitting diode 110 in branch 101(*a*) is coupled to the cathode terminal of light-emitting diode 112 in branch 102(*c*), which is two branches away, by shunt 130. Shunt 130 comprises additional light-emitting diode 120.

Similarly, the anode terminal of light-emitting diode 111 in branch 101(*b*) is coupled to the cathode terminal of light-emitting diode 113 in branch 102(*d*), which is two branches away, by shunt 131. Shunt 131 comprises additional light-emitting diode 121. Furthermore, and as shown in the figure, the anode terminals of each light-emitting diodes 112 through 117 is coupled, via shunts 132 through 137 respectively, to the cathode terminals of light-emitting diodes which are two branches away. Shunts 132 through 137 comprise light-emitting diodes 122 through 127, respectively.

In this embodiment, in the second cell (n=2), each shunt is connected to the anode terminal of a light-emitting diode in a first branch and to the cathode terminal of a light-emitting diode in a second branch, wherein the second branch is $2^2$, or four, branches away from the first branch. For instance, in cell 103 of the arrangement illustrated by FIG. 3 (cell 103 is the second cell, therefore n=2), the anode terminal of light-emitting diode 150 in branch 101(*a*) is coupled to the cathode terminal of light-emitting diode 154 in branch 102(*e*), which is four branches away, by shunt 170. Shunt 170 comprises additional light-emitting diode 160.

Similarly, the anode terminal of light-emitting diode 151 in branch 101(*b*) is coupled to the cathode terminal of light-emitting diode 155 in branch 102(*f*), which is four branches away, by shunt 171. Shunt 171 comprises additional light-emitting diode 161. Furthermore, and as shown in cell 103 of the figure, the anode terminals of each light-emitting diodes 152 through 157 is coupled, via shunts 172 through 177 respectively, to the cathode terminals of light-emitting diodes which are four branches away. Shunts 172 through 177 comprise light-emitting diodes 162 through 167, respectively.

Light-emitting diodes which are connected according to the arrangement shown in FIG. 3 have a high level of reliability since, in open-circuit failure mode, an entire branch does not extinguish because of the failure of a light-emitting diode in that branch. Instead, current flows via shunts 120 through 127 and shunts 130 through 137 to bypass a failed light-emitting diode. For instance, if light-emitting diode 110 of FIG. 3 fails, current still flows to (and thereby illuminates) light-emitting diode 150 via branch 132 and light-emitting diode 122. In addition, current from branch 101(*a*) still flows to branches 101(*c*) via shunt 130.

Figure 1:
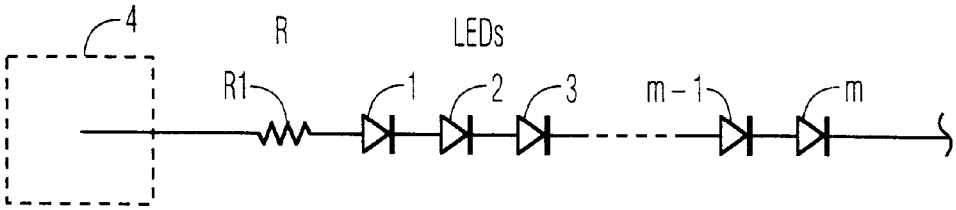
FIG. 1 PRIOR ART
FIG. 1 illustrates a typical arrangement of light-emitting diodes, as employed by a lighting system of the prior art.
Figure 2A:
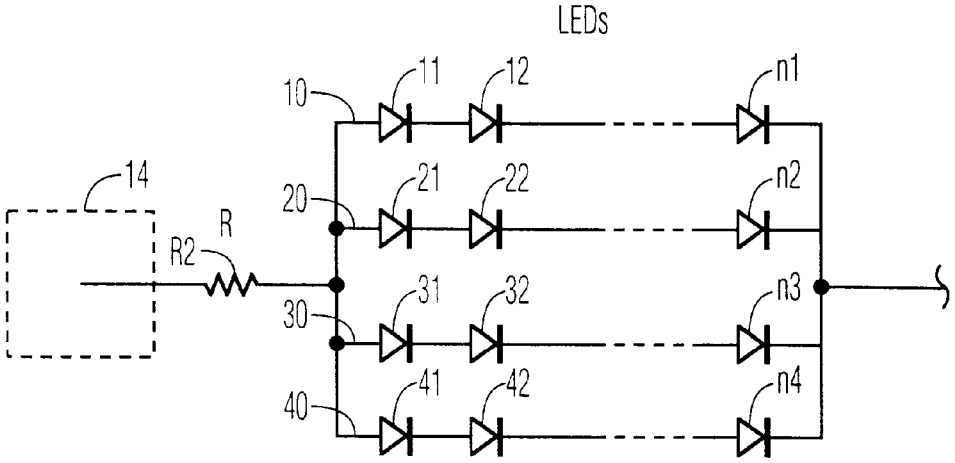
FIG. 2A PRIOR ART
FIG. 2(*a*) illustrates another typical arrangement of light-emitting diodes, as employed by a lighting system of the prior art.
Figure 2B:
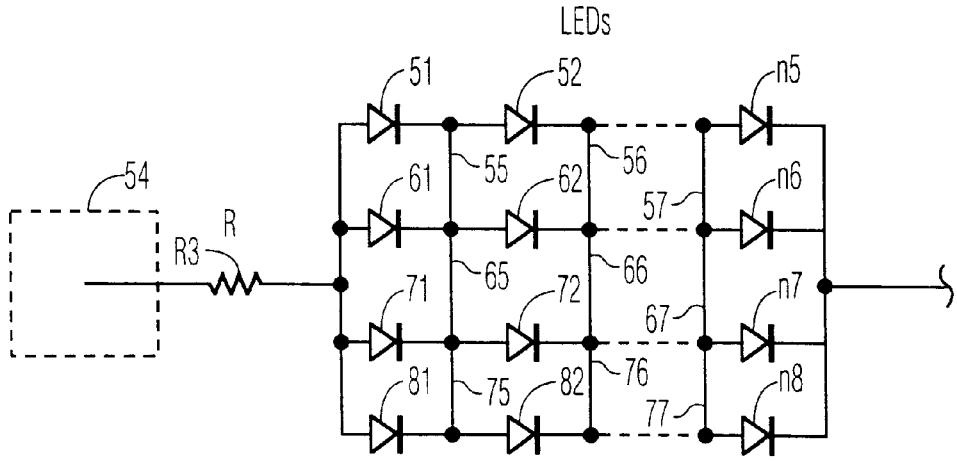
FIG. 2B PRIOR ART

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 110 short circuits, current will flow through upper branch 101(*a*), which has no voltage drop, and will also flow through light-emitting diode 120 in shunt 130. Light-emitting diode 120 remains illuminated because the current flowing through it drops only a small amount, unlike that which occurs in the arrangement of FIG. 2(*b*). The remaining light-emitting diodes in the cell also remain illuminated because a current flow is maintained through them via branches 101(*b*) through 101(*h*) and the corresponding shunts.

In addition, arrangement 100 of light-emitting diodes also alleviates other problems experienced by the light-emitting diode arrangements of the prior art. For instance, light-emitting diode arrangement 100 of the present invention, according to one embodiment, insures that all of the light-emitting diodes in the arrangement have the same brightness without the requirement that the light-emitting diodes have tightly matched forward voltage characteristics. For instance, light-emitting diodes 110 through 117 and light-emitting diodes 120 through 127 of the arrangement shown in FIG. 3 may have forward voltage characteristics which are not as tightly matched as the forward voltage characteristics of light-emitting diodes in prior art arrangements. This follows because, unlike the arrangements of the prior art, the light-emitting diodes in cell 102 of arrangement 100 are not parallel-connected to each other.

Because light-emitting diodes in each cell are not parallel-connected, the voltage drop across the diodes does not need to be the same. Therefore, forward voltage characteristics of each light-emitting diode need not be equal to others in order to provide similar amounts of illumination. In other words, the current flow through a light-emitting diode having a lower forward voltage will not increase in order to equalize the forward voltage of the light-emitting diode with the higher forward voltage of another light-emitting diode. Because it is not necessary to have light-emitting diodes with tightly matched forward voltage characteristics, the present invention alleviates the need for binning light-emitting diodes with tightly matched voltage characteristics.

FIG. 4

Figure 4:
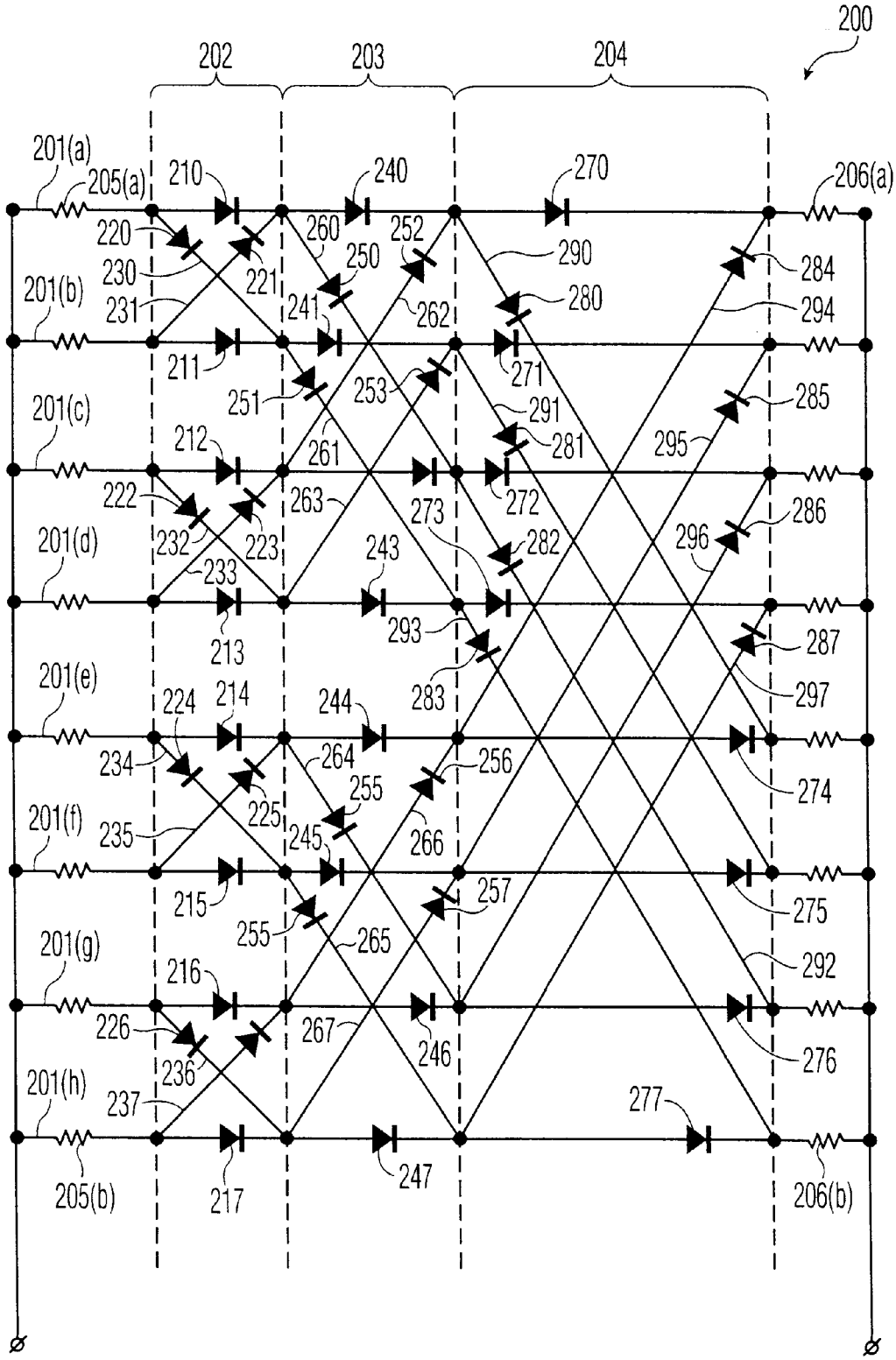
FIG. 4 illustrates an arrangement of light-emitting diodes, as employed by a lighting system, according to another embodiment of the present invention.

FIG. 4 illustrates an arrangement 200 of light-emitting diodes, as employed by a lighting system, according to another embodiment of the present invention. The arrangement shown in FIG. 4 illustrates cascading cells 202, 203 and 204 of light-emitting diodes. As previously noted, in accordance with various embodiments of the present invention, any number of cells may be connected successively to each other in cascading fashion.

Similar to the arrangement illustrated in FIG. 3, each cell of arrangement 200 comprises N branches In the embodiment shown, N=8, and thus arrangement 200 comprises 8 branches, designated as branches 201(*a*) through 201(*h*). Branches 201(*a*) through 201(*h*) are initially (i.e.—before the first cell 201) coupled in parallel via resistors 205(*a*) through 205(*h*), respectively. The resistors preferably have the same resistive values, to insure that an equal amount of current is received via each branch. Power supply source 204 provides current to the light-emitting diodes. Additional resistors 206(*a*) through 206(*h*) are employed in arrangement 200 at the cathode terminals of the last light-emitting diodes.

Again, in each cell, each branch comprises a light-emitting diode. For instance, branch 201(*a*) comprises light-emitting diode 210 in first cell 202, light-emitting diode 240 in second cell 203, and light-emitting diode 270 in third cell 204. Similarly, branches 201(*b*) through 201(*h*) comprise light-emitting diodes 211 through 217, respectively, in first cell 202, light-emitting diodes 241 through 247, respectively, in second cell 203, and light-emitting diodes 271 through 277, respectively, in second cell 204.

The anode terminal of each light-emitting diode is connected to the cathode terminal of a corresponding light-emitting diode in a different branch. This connection is again made by a shunt which, according to one embodiment, comprises another light-emitting diode. Depending on the cell, the shunt is connected from a first branch to a second branch, wherein the second branch is a specifiable number of branches away from the first branch. In the embodiment illustrated in FIG. 4, each shunt is connected from the anode terminal of a light-emitting diode in a first branch and to the cathode terminal of a light-emitting diode in a second branch, wherein the second branch is $2^{n-1}$ branches away from the first branch and n is the cell number, ranging from 1 to K.

Thus, in the first cell (n=1), each shunt is connected to the anode terminal of a light-emitting diode in a first branch and to the cathode terminal of a light-emitting diode in a second branch, wherein the second branch is $2^{1-1}$, or one, branch away from the first branch. For instance, in cell 202 of the arrangement illustrated by FIG. 4 (cell 202 is the first cell, therefore n=1), the anode terminal of light-emitting diode 210 in branch 201(*a*) is coupled to the cathode terminal of light-emitting diode 211 in branch 202(*b*), which is one branch away, by shunt 230. Shunt 230 comprises additional light-emitting diode 220.

Similarly, the anode terminal of light-emitting diode 212 in branch 201(*c*) is coupled to the cathode terminal of light-emitting diode 213 in branch 201(*d*), which is one branch away, by shunt 232. Shunt 232 comprises additional light-emitting diode 222. Furthermore, for each cell such as 202, each branch includes only one shunt connection coupling the branch to an adjacent branch. For example, branch 201(*b*) only comprises shunt 231, whereas branch 201(*c*) only comprises shunt 232, and so forth.

In this embodiment, in the second cell (n=2), each shunt is connected to the anode terminal of a light-emitting diode in a first branch and to the cathode terminal of a light-emitting diode in a second branch, wherein the second branch is $2^{2-1}$, or two, branches away from the first branch. For instance, in cell 203 of the arrangement illustrated by FIG. 4 (cell 203 is the second cell, therefore n=2), the anode terminal of light-emitting diode 240 in branch 201(*a*) is coupled to the cathode terminal of light-emitting diode 242 in branch 201(*c*), which is two branches away, by shunt 260. Shunt 260 comprises additional light-emitting diode 250.

Similarly, the anode terminal of light-emitting diode 244 in branch 201(*e*) is coupled to the cathode terminal of light-emitting diode 246 in branch 201(*g*), which is two branches away, by shunt 264. Shunt 264 comprises additional light-emitting diode 254. Furthermore, for cell 203, each branch includes only one shunt connection coupling the branch to an adjacent branch. For example, branch 201(*b*) only comprises shunt 261, whereas branch 201(*c*) only comprises shunt 262, and so forth.

In this embodiment, in the third cell (n=3), each shunt is connected to the anode terminal of a light-emitting diode in a first branch and to the cathode terminal of a light-emitting diode in a second branch, wherein the second branch is $2^{3-1}$, or four, branches away from the first branch. For instance, in cell 204 of the arrangement illustrated by FIG. 4 (cell 204 is the second cell, therefore n=3), the anode terminal of light-emitting diode 270 in branch 201(*a*) is coupled to the cathode terminal of light-emitting diode 274 in branch 102(*e*), which is four branches away, by shunt 290. Shunt 290 comprises additional light-emitting diode 280.

Similarly, the anode terminal of light-emitting diode 274 in branch 201(*e*) is coupled to the cathode terminal of light-emitting diode 270 in branch 201(*a*), which is four branches away, by shunt 294. Shunt 294 comprises additional light-emitting diode 284. Furthermore, for cell 204, each branch includes only one shunt connection coupling the branch to an adjacent branch. For example, branch 201(*b*) only comprises shunt 291, whereas branch 201(*c*) only comprises shunt 292, and so forth.

As previously discussed in connection with the device illustrated in FIG. 3, light-emitting diodes which are connected according to the arrangement shown in FIG. 4 have a high level of reliability since, in open-circuit failure mode, an entire branch does not extinguish because of the failure of a light-emitting diode in that branch. Instead, current flows via the shunts to bypass a failed light-emitting diode. For instance, if light-emitting diode 210 of FIG. 4 fails, current still flows to (and thereby illuminates) light-emitting diodes 240 and 270 via branch 231 and light-emitting diode 221. In addition, current from branch 201(*a*) still flows to branches 201(*b*) via shunt 230.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 210 short circuits, current will flow through upper branch 201(*a*), which has no voltage drop, and will also flow through light-emitting diode 220 in shunt 230. Light-emitting diode 220 remains illuminated because the current flowing through it drops only a small amount, unlike that which occurs in the arrangement of FIG. 2(*b*). The remaining light-emitting diodes in the cell also remain illuminated because a current flow is maintained through them via branches 201(*b*) through 201(*h*) and the corresponding shunts.

In addition, arrangement 200 of light-emitting diodes also alleviates other problems experienced by the light-emitting diode arrangements of the prior art. For the reasons discussed in connection with the embodiment shown in FIG. 3, light-emitting diode arrangement 200 of the present invention insures that all of the light-emitting diodes in the arrangement have the same brightness without the requirement that the light-emitting diodes have tightly matched forward voltage characteristics.

FIG. 5

Figure 5:
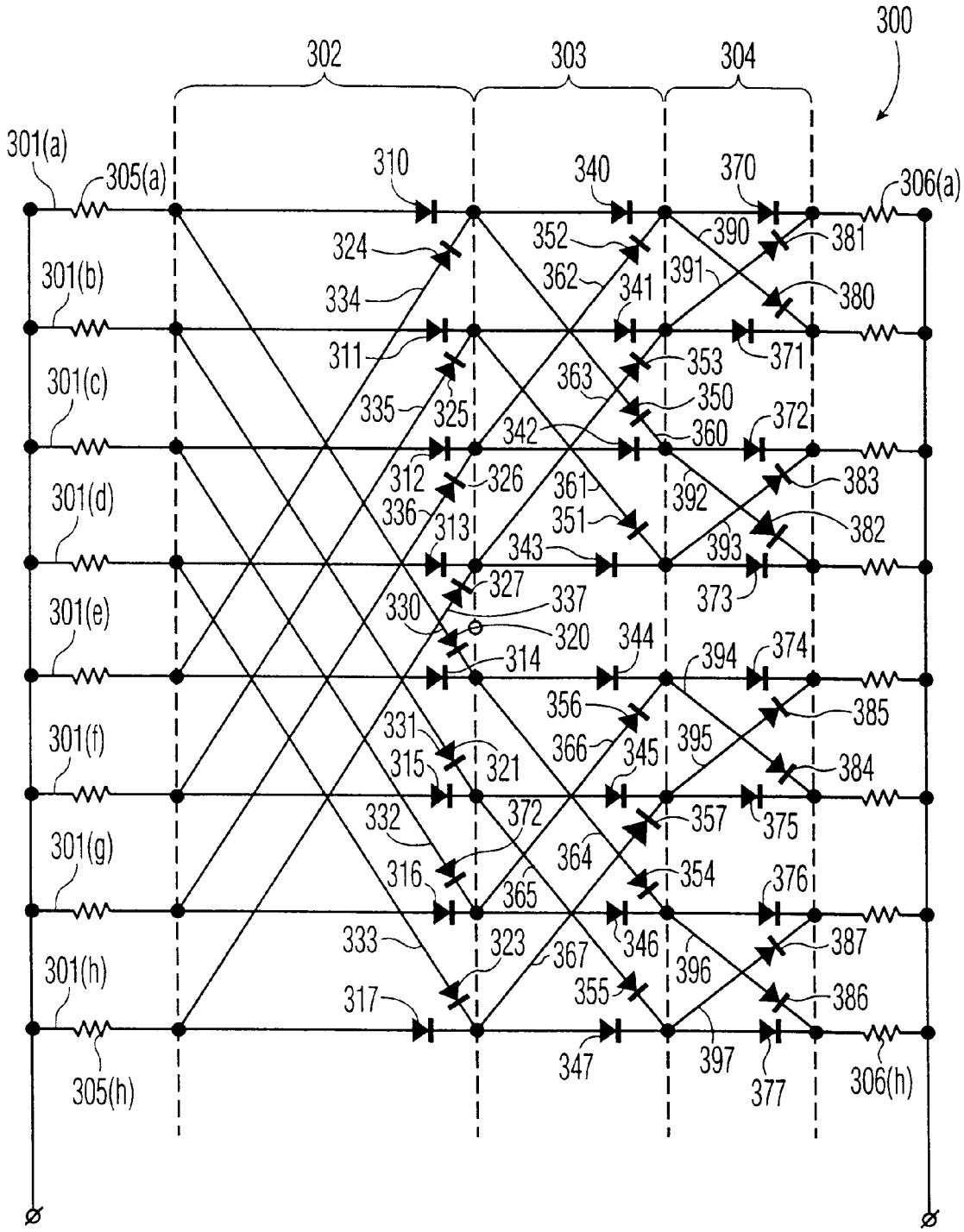
FIG. 5 illustrates an arrangement of light-emitting diodes, as employed by a lighting system, according to still another embodiment of the present invention.

FIG. 5 illustrates an arrangement 300 of light-emitting diodes, as employed by a lighting system, according to still another embodiment of the present invention. The arrangement shown in FIG. 5 illustrates cascading cells 302, 303 and 304 of light-emitting diodes. As previously noted, in accordance with various embodiments of the present invention, any number of cells may be connected successively to each other in cascading fashion. As will be explained further below, in this embodiment, each shunt is connected to the anode terminal of a light-emitting diode in a first branch and to the cathode terminal of a light-emitting diode in a second branch, wherein the second branch is $2^{K-n}$ branches away from the first branch, such that K is the number of cells in the structure and n is the cell number Similar to the arrangement illustrated in FIGS. 3 and 4, each cell of arrangement 300 comprises N branches. In the embodiment shown, N=8, and thus arrangement 300 comprises 8 branches, designated as branches 301(*a*) through 301(*h*). Branches 301(*a*) through 301(*h*) are initially (i.e.—before the first cell 301) coupled in parallel via resistors 305(*a*) through 305(*h*), respectively. The resistors preferably have the same resistive values, to insure that an equal amount of current is received via each branch. Power supply source 304 provides current to the light-emitting diodes. Additional resistors 306(*a*) through 306(*h*) are employed in arrangement 300 at the cathode terminals of the last light-emitting diodes.

Each branch comprises light-emitting diodes coupled in series. A set of corresponding light-emitting diodes in each branch (together with the light-emitting diodes of the coupling shunts which are explained in detail below) define a cell. Thus, branch 301(*a*) comprises light-emitting diode 310 in first cell 302, light-emitting diode 340 in second cell 303, and light-emitting diode 370 in third cell 304, each coupled in series. Furthermore, branches 301(*b*) through 301(*h*) comprise light-emitting diodes 311 through 317, respectively, in first cell 302, light-emitting diodes 341 through 347, respectively, in second cell 303, and light-emitting diodes 371 through 377, respectively, in second cell 304.

The anode terminal of each light-emitting diode is connected to the cathode terminal of a light-emitting diode in a different branch. This connection is again made by a shunt which comprises another light-emitting diode. Depending on the cell, the shunt is connected from a first branch to a second branch, wherein the second branch is a specifiable number of branches away from the first branch. As previously mentioned, each shunt is connected to the anode terminal of a light-emitting diode in a first branch and to the cathode terminal of a light-emitting diode in a second branch, wherein the second branch is $2^{K-n}$ branches away from the first branch, such that K is the number of cells in the structure and n is the cell number.

Thus, in the first cell (n=1), each shunt is connected to the anode terminal of a light-emitting diode in a first branch and to the cathode terminal of a light-emitting diode in a second branch, wherein the second branch is $2^{3-1}$, or four, branches away from the first branch. For instance, in cell 302 of the arrangement illustrated by FIG. 5 (cell 302 is the first cell, therefore n=1), the anode terminal of light-emitting diode 310 in branch 301(*a*) is coupled to the cathode terminal of light-emitting diode 314 in branch 301(*e*), which is four branches away, by shunt 330. Shunt 330 comprises additional light-emitting diode 320.

Similarly, the anode terminal of light-emitting diode 312 in branch 301(*c*) is coupled to the cathode terminal of light-emitting diode 316 in branch 302(*g*), which is four branches away, by shunt 332. Shunt 332 comprises additional light-emitting diode 322. Furthermore, for cell 302, each branch includes only one shunt connection coupling the branch to an adjacent branch. For example, branch 301(*b*) only comprises shunt 331, whereas branch 301(*c*) only comprises shunt 332, and so forth.

In this embodiment, in the second cell (n=2), each shunt is connected to the anode terminal of a light-emitting diode in a first branch and to the cathode terminal of a light-emitting diode in a second branch, wherein the second branch is $2^{3-2}$, or two, branches away from the first branch. For instance, in cell 303 of the arrangement illustrated by FIG. 5 (cell 303 is the second cell, therefore n=2), the anode terminal of light-emitting diode 340 in branch 301(*a*) is coupled to the cathode terminal of light-emitting diode 342 in branch 102(*c*), which is two branches away, by shunt 360. Shunt 360 comprises additional light-emitting diode 350.

Similarly, the anode terminal of light-emitting diode 344 in branch 301(*e*) is coupled to the cathode terminal of light-emitting diode 346 in branch 301(*g*), which is two branches away, by shunt 364. Shunt 364 comprises additional light-emitting diode 354. Furthermore, for cell 303, each branch includes only one shunt connection coupling the branch to an adjacent branch. For example, branch 301(*b*) only comprises shunt 361, whereas branch 301(*c*) only comprises shunt 362, and so forth.

In this embodiment, in the third cell (n=3), each shunt is connected to the anode terminal of a light-emitting diode in a first branch and to the cathode terminal of a light-emitting diode in a second branch, wherein the second branch is $2^{3-3}$, or one, branch away from the first branch. For instance, in cell 304 of the arrangement illustrated by FIG. 5 (cell 304 is the second cell, therefore n=3), the anode terminal of light-emitting diode 370 in branch 301(*a*) is coupled to the cathode terminal of light-emitting diode 371 in branch 302(*b*), which is one branch away, by shunt 390. Shunt 390 comprises additional light-emitting diode 380.

Similarly, the anode terminal of light-emitting diode 374 in branch 301(*e*) is coupled to the cathode terminal of light-emitting diode 375 in branch 301(*f*), which is one branch away, by shunt 394. Shunt 394 comprises additional light-emitting diode 384. For each cell such as 304, each branch includes only one shunt connection coupling the branch to an adjacent branch. For example, branch 301(*b*) only comprises shunt 391, whereas branch 301(*c*) only comprises shunt 392, and so forth.

As previously discussed in connection with the device illustrated in FIGS. 3 and 4, light-emitting diodes which are connected according to the arrangement shown in FIG. 5 have a high level of reliability since, in open-circuit failure mode, an entire branch does not extinguish because of the failure of a light-emitting diode in that branch. Instead, current flows via the shunts to bypass a failed light-emitting diode. For instance, if light-emitting diode 310 of FIG. 5 fails, current still flows to (and thereby illuminates) light-emitting diodes 340 and 370 via branch 334 and light-emitting diode 324. In addition, current from branch 301(*a*) still flows to branch 301(*e*) via shunt 330.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 310 short circuits, current will flow through upper branch 301(*a*), which has no voltage drop, and will also flow through light-emitting diode 320 in shunt 330. Light-emitting diode 320 remains illuminated because the current flowing through it drops only a small amount, unlike that which occurs in the arrangement of FIG. 2(*b*). The remaining light-emitting diodes in the cell also remain illuminated because a current flow is maintained through them via branches 301(*b*) through 301(*h*) and the corresponding shunts.

In addition, arrangement 300 of light-emitting diodes also alleviates other problems experienced by the light-emitting diode arrangements of the prior art. For the reasons discussed in connection with the embodiment shown in FIGS. 3 and 4, light-emitting diode arrangement 300 of the present invention insures that all of the light-emitting diodes in the arrangement have the same brightness without the requirement that the light-emitting diodes have tightly matched forward voltage characteristics.

FIG. 6

Figure 6:
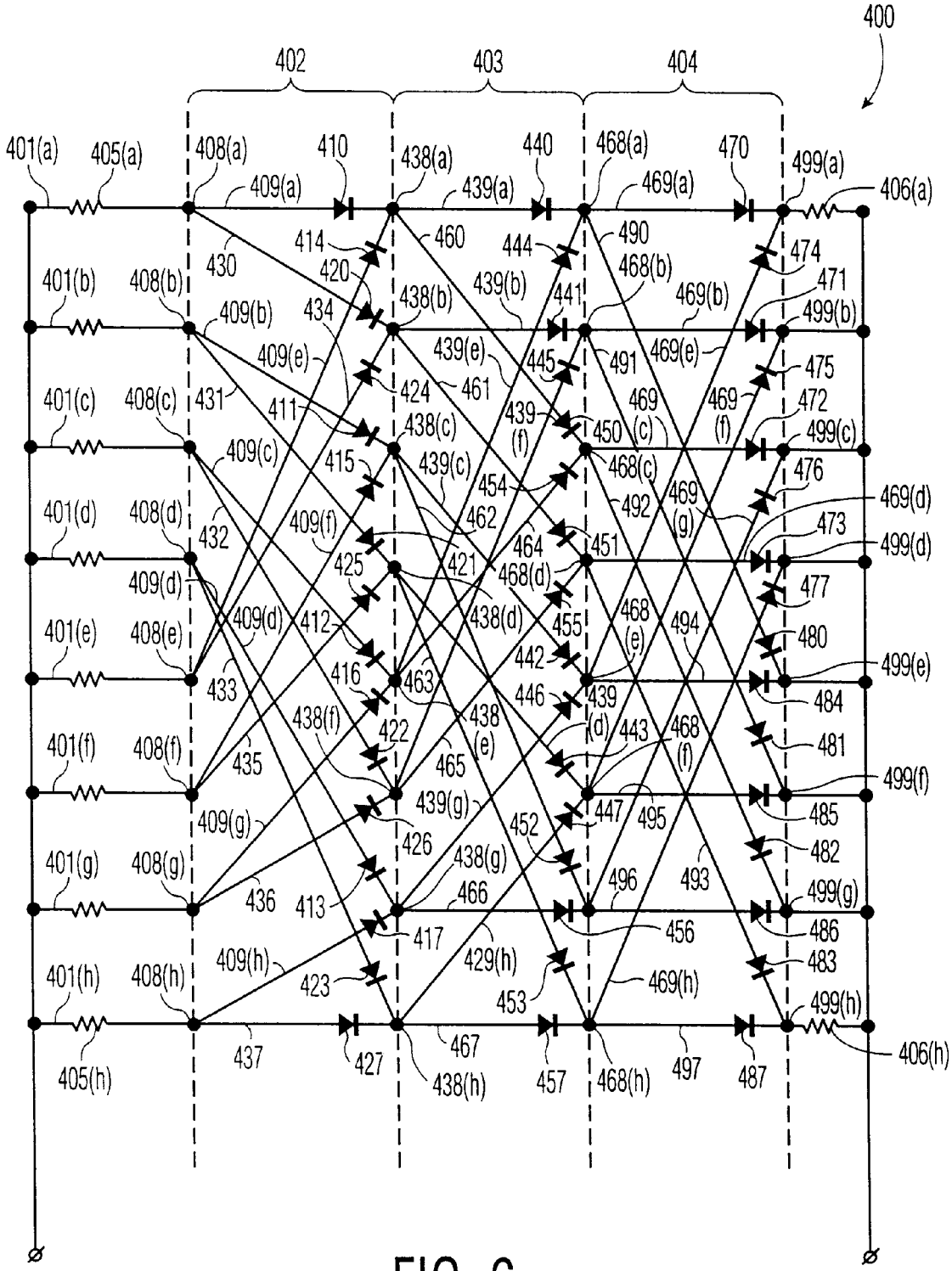
FIG. 6 illustrates an arrangement of light-emitting diodes, as employed by a lighting system, according to still another embodiment of the present invention.

FIG. 6 illustrates an arrangement 400 of light-emitting diodes, as employed by a lighting system, according to still another embodiment of the present invention. The arrangement shown in FIG. 6 illustrates cascading cells 402, 403 and 404 of light-emitting diodes. It is noted that, in accordance with various embodiments of the present invention, any number of cells may be connected successively to each other in cascading fashion.

Branches 401(*a*) through 401(*h*) are initially (i.e.—before the first cell) coupled in parallel via resistors 405(*a*) through 405(*h*), respectively. The resistors preferably have the same resistive values, to insure that an equal amount of current is received via each branch. Power supply source 404 provides current to the light-emitting diodes. Additional resistors 405(*a*) through 405(*h*) are employed in arrangement 400 at the cathode terminals of the last light-emitting diodes in the arrangement shown.

In this embodiment, each cell of arrangement 400 comprises N input node terminals and N output node terminals. Because the cells are connected in cascading fashion, the output node terminals of a first cell correspond to the input node terminals of a second cell. In the embodiment shown, N=8, and thus each cell of arrangement 400 comprises 8 input node terminals and 8 output node terminals. In first cell 402, the input node terminals are designated as input node terminals 408(*a*) through 408(*h*), and the output node terminals are designated as output node terminals 438(*a*) through 438(*h*). In second cell 403, the input node terminals are designated as node terminals 438(*a*) through 438(*h*) (i.e.—corresponding to the output node terminals of the previous cell), and the output node terminals are designated as output node terminals 468(*a*) through 468(*h*). Finally, in third cell 404, the input node terminals are designated as node terminals 468(*a*) through 468(*h*) (i.e.—again corresponding to the output node terminals of the previous cell), and the output node terminals are designated as output node terminals 499(*a*) through 499(*h*).

According to this embodiment, each input node terminal in a cell is connected to two output node terminals via electrically-conductive branches. As a result, each output node terminal is also connected to two input node terminals via electrically-conductive branches. In each cell, each branch comprises a light-emitting diode. A set of corresponding light-emitting diodes (together with the light-emitting diodes in the coupling shunts as explained below) define a cell. As will be discussed further below, for all of the cells, each input node terminal in an upper half of the structure, along with a corresponding input node terminal in the lower half of the structure, are connected to the same respective output node terminals.

In this embodiment, in first cell 402, the upper half of the structure is defined by branches 409(*a*) through 409(*d*), while the lower half of the structure is defined by branches 409(*e*) through 409(*h*). As previously mentioned, each input terminal in the upper half of the structure, along with a corresponding input terminal in the lower half, are connected to the same two output terminals. Thus, for instance, the first input terminal of the upper half, namely input node terminal 408(*a*), and a corresponding first input node terminal 408(*e*) of the lower half, are connected to the same two output node terminals, namely output node terminals 438(*a*) and 438(*b*). Likewise, the second input node terminal of the upper half of the structure along with a corresponding second input node terminal in the lower half, namely terminals 408(*b*) and 408(*f*), are connected to the same two output node terminals, namely output terminals 438(*b*) and 438(*d*), and so forth.

In second cell 403, the upper half of the structure is defined by terminals 438(*a*) and 468(*a*) through 438(*d*) and 468(*d*), respectively, while the lower half of the structure is defined by terminals 438(*e*) and 468(*e*) through terminals 438(*h*) and 468(*h*), respectively. As in the first cell, each input node terminal in the upper half of the structure, along with a corresponding input node terminal in the lower half, are connected to the same output node terminals. Thus, for instance, the first input terminal of the upper half, namely input node terminal 438(*a*), and a corresponding input node terminal of the lower half, namely input node terminal 438(*e*), are connected to the same two output node terminals, namely output node terminals 468(*a*) and 468(*c*). Likewise, the second input node terminals of the upper and lower halves of the structure, namely input terminals 438(*b*) and 438(*f*), are connected to the same two output node terminals, namely output terminals 468(*b*) and 468(*d*), and so forth.

Likewise, in third cell 404, the upper half of the structure is defined by terminals 468(*a*) and 499(*a*) through 468(*d*) and 499(*d*), respectively, while the lower half of the structure is defined by terminals 468(*e*) and 499(*e*) through terminals 468(*h*) and 499(*h*), respectively. As in the first cell, each input node terminal in the upper half of the structure, along with a corresponding input node terminal in the lower half, are connected to the same output node terminals. Thus, for instance, the first input terminal of the upper half, namely input node terminal 468(*a*), and a corresponding input node terminal of the lower half, namely input node terminal 468(*e*), are connected to the same two output node terminals, namely output node terminals 499(*a*) and 499(*e*). Likewise, the second input node terminals of the upper and lower halves of the structure, namely input terminals 468(*b*) and 468(*f*), are connected to the same two output node terminals, namely output terminals 499(*b*) and 499(*f*), and so forth.

As previously discussed in connection with the device illustrated in FIGS. 3 through 5, light-emitting diodes which are connected according to the arrangement shown in FIG. 6 have a high level of reliability since, in open-circuit failure mode, an entire branch does not extinguish because of the failure of a light-emitting diode in that branch. Instead, current flows via the shunts to bypass a failed light-emitting diode. For instance, if light-emitting diode 410 of FIG. 6 fails, current still flows to (and thereby illuminates) light-emitting diodes 440 and 470 via branch 409(*e*) and light-emitting diode 414. In addition, current from branch 401(*a*) still flows to light-emitting diodes 441 and 471 via shunt 430.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 410 short circuits, current will flow through upper branch 401(*a*), which has no voltage drop, and will also flow through light-emitting diode 420 in shunt 430. Light-emitting diode 420 remains illuminated because the current flowing through it drops only a small amount, unlike that which occurs in the arrangement of FIG. 2(*b*). The remaining light-emitting diodes in the cell also remain illuminated because a current flow is maintained through them via branches 401(*b*) through 401(*h*) and the corresponding shunts.

In addition, arrangement 400 of light-emitting diodes also alleviates other problems experienced by the light-emitting diode arrangements of the prior art. For the reasons discussed in connection with the embodiment shown in FIGS. 3 through 5, light-emitting diode arrangement 400 of the present invention insures that all of the light-emitting diodes in the arrangement have the same brightness without the requirement that the light-emitting diodes have tightly matched forward voltage characteristics.

FIG. 7

Figure 7:
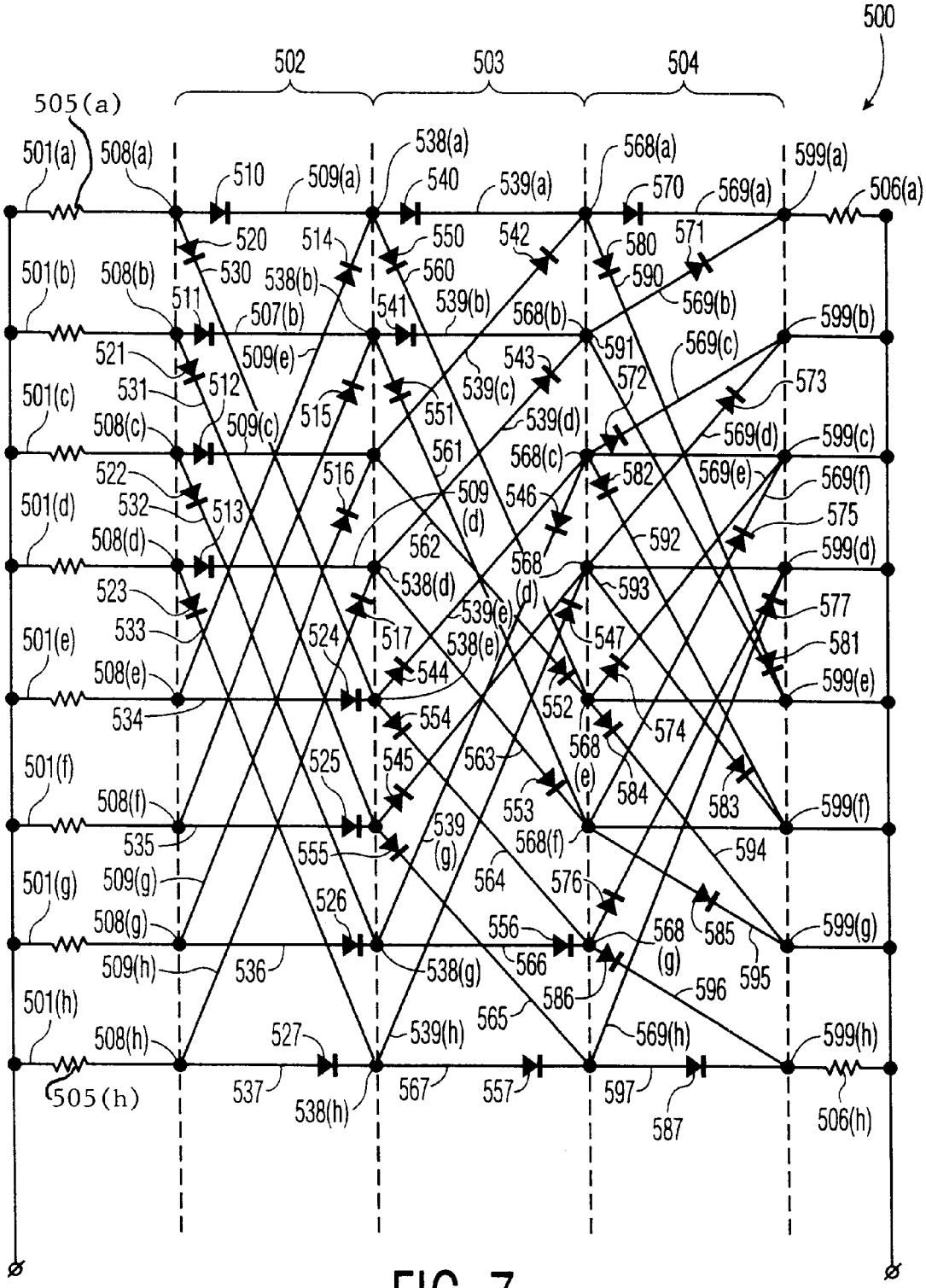
FIG. 7 illustrates an arrangement of light-emitting diodes, as employed by a lighting system, according to still another embodiment of the present invention.

FIG. 7 illustrates an arrangement 500 of light-emitting diodes, as employed by a lighting system, according to still another embodiment of the present invention. The arrangement shown in FIG. 7 illustrates cascading cells 502, 503 and 504 of light-emitting diodes. As in the previously illustrated embodiments, branches 501(*a*) through 501(*h*) are initially (i.e.—before the first cell) coupled in parallel via resistors 505(*a*) through 505(*h*), respectively. Power supply source 504 provides current to the light-emitting diodes. Additional resistors 505(*a*) through 505(*h*) are employed in arrangement 500 at the cathode terminals of the last light-emitting diodes.

As previously shown in FIG. 6, each cell of arrangement 500 comprises N input node terminals and N output node terminals. Because the cells are connected in cascading fashion, the output node terminals of a first cell correspond to the input node terminals of a second cell. In the embodiment shown, N=8, and thus each cell of arrangement 500 comprises 8 input node terminals and 8 output node terminals. In first cell 502, the input node terminals are designated as input node terminals 508(*a*) through 508(*h*), and the output node terminals are designated as output node terminals 538(*a*) through 538(*h*). In second cell 503, the input node terminals are designated as node terminals 538(*a*) through 538(*h*) (i.e.—corresponding to the output node terminals of the previous cell), and the output node terminals are designated as output node terminals 568(*a*) through 568(*h*). Finally, in third cell 504, the input node terminals are designated as node terminals 568(*a*) through 568(*h*) (i.e.—again corresponding to the output node terminals of the previous cell), and the output node terminals are designated as output node terminals 599(*a*) through 599(*h*).

According to this embodiment, each input node terminal in a cell is connected to two output node terminals via electrically-conductive branches. As a result, each output node terminal is also connected to two input node terminals via electrically-conductive branches. In each cell, each branch comprises a light-emitting diode. A set of corresponding light-emitting diodes (together with the light-emitting diodes in the coupling shunts as explained below) define a cell. As will be discussed further below, for all of the cells, each output node terminal in an upper half of the structure, along with a corresponding output node terminal in the lower half of the structure, are connected to the same input node terminals.

In this embodiment, in first cell 502, the upper half of the structure is defined by branches 509(*a*) through 509(*d*), while the lower half of the structure is defined by branches 509(*e*) through 509(*h*). As previously mentioned, each output node terminal in the upper half of the structure, along with a corresponding output node terminal in the lower half, are connected to the same input node terminals. Thus, for instance, the first output terminal of the upper half, namely input terminal 538(*a*), and a corresponding output terminal of the lower half, namely output terminal 538(*e*), are connected to the same two input terminals, namely input terminals 508(*a*) and 508(*e*). Likewise, the second output node terminal of the upper half of the structure along with a corresponding output terminal in the lower half, namely terminals 538(*b*) and 538(*f*), are connected to the same two output node terminals, namely output terminals 508(*b*) and 508(*f*), and so forth.

In second cell 503, the upper half of the structure is defined by terminals 538(*a*) and 568(*a*) through 538(*d*) and 568(*d*), respectively, while the lower half of the structure is defined by terminals 538(*e*) and 568(*e*) through terminals 538(*h*) and 568(*h*), respectively. As in the first cell, each output node terminal in the upper half of the structure, along with a corresponding output node terminal in the lower half, are connected to the same input node terminals. Thus, for instance, the first output terminal of the upper half, namely output node terminal 568(*a*), and a corresponding output node terminal of the lower half, namely output node terminal 568(*e*), are connected to the same two input node terminals, namely input node terminals 538(*a*) and 538(*c*). Likewise, the second output node terminals of the upper and lower halves of the structure, namely output terminals 568(*b*) and 568(*f*), are connected to the same two input node terminals, namely input terminals 538(*b*) and 538(*d*), and so forth.

Furthermore, in third cell 504, the upper half of the structure is defined by terminals 568(*a*) and 599(*a*) through 568(*d*) and 599(*d*), respectively, while the lower half of the structure is defined by terminals 568(*e*) and 599(*e*) through terminals 568(*h*) and 599(*h*), respectively. As in the first cell, each output node terminal in the upper half of the structure, along with a corresponding output node terminal in the lower half, are connected to the same input node terminals. Thus, for instance, the first output terminal of the upper half, namely output node terminal 599(*a*), and a corresponding output node terminal of the lower half, namely output node terminal 599(*e*), are connected to the same two input node terminals, namely input node terminals 568(*a*) and 568(*b*). Likewise, the second output node terminals of the upper and lower halves of the structure, namely output terminals 599(*b*) and 599(*f*), are connected to the same two input node terminals, namely input terminals 568(*c*) and 568(*d*), and so forth.

As discussed in connection with the previous embodiments, light-emitting diodes which are connected according to the arrangement shown in FIG. 7 have a high level of reliability since, in open-circuit failure mode, an entire branch does not extinguish because of the failure of a light-emitting diode in that branch. Instead, current flows via the shunts to bypass a failed light-emitting diode. For instance, if light-emitting diode 510 of FIG. 7 fails, current still flows to (and thereby illuminates) light-emitting diodes 540 and 570 via branch 509(*e*) and light-emitting diode 514. In addition, current from branch 501(*a*) still flows to light-emitting diodes 541 via shunt 530.

Furthermore, in short-circuit failure mode, light-emitting diodes in other branches and shunts do not extinguish because of the failure of a light-emitting diode in one branch. This follows because the light-emitting diodes are not connected in parallel. For example, if light-emitting diode 510 short circuits, current will flow through upper branch 501(*a*), which has no voltage drop, and will also flow through light-emitting diode 520 in shunt 530. Light-emitting diode 520 remains illuminated because the current flowing through it drops only a small amount, unlike that which occurs in the arrangement of FIG. 2(*b*). The remaining light-emitting diodes in the cell also remain illuminated because a current flow is maintained through them via branches 501(*b*) through 501(*h*) and the corresponding shunts.

In addition, arrangement 500 of light-emitting diodes also alleviates other problems experienced by the light-emitting diode arrangements of the prior art. For the reasons discussed in connection with the above embodiments, light-emitting diode arrangement 500 of the present invention insures that all of the light-emitting diodes in the arrangement have the same brightness without the requirement that the light-emitting diodes have tightly matched forward voltage characteristics, thereby reducing the additional manufacturing costs and time which is necessitated by binning operations.

While there has been shown and described particular embodiments of the invention, it will be obvious to those skilled in the art that changes and modifications can be made therein without departing from the invention, and therefore, the appended claims shall be understood to cover all such changes and modifications as fall within the true spirit and scope of the invention.

We claim:

1. A lighting system comprising:

a power supply source;

a plurality of electrically-conductive branches, said branches coupled in parallel to said power supply source, each of said branches comprising at least one light-emitting diode; and a plurality of shunts, wherein each one of said shunts couples an anode terminal of a respective first light-emitting diode in one of said branches to a cathode terminal of a corresponding light-emitting diode in a different one of said branches, such that a corresponding set of light-emitting diodes together with their corresponding coupling shunts define a lattice-connected cell, and wherein said system comprises at least two said cells, and said branches along with said shunts are coupled to form a cascaded-cell lattice arrangement.

2. The lighting system according to claim 1, wherein said cells are coupled together in a cascading arrangement such that said shunts couple an anode terminal of a first light-emitting diode to a cathode terminal of a light-emitting diode which is $2^n$ branches away from said first light-emitting diode, wherein n is the cell number within said cascading arrangement.

3. The lighting system according to claim 1, wherein said cells are coupled together in a cascading arrangement such that said shunts couple an anode terminal of a first light-emitting diode to a cathode terminal of a light-emitting diode which is $2^{n-1}$ branches away from said first light-emitting diode, wherein n is the cell number within said cascading arrangement.

4. The lighting system according to claim 1, wherein K of said cells are coupled together in a cascading arrangement such that said shunts couple an anode terminal of a first light-emitting diode to a cathode terminal of a light-emitting diode which is $2^{K-n}$ branches away from said first light-emitting diode, wherein K is the number of said cells in said lighting system and n is a cell number within said cascading arrangement.

5. The lighting system according to claim 1, wherein each said cell comprises N input node terminals and N output node terminals, each said output node of a given cell is a said input node of a next cell of said cascaded-cell arrangement, respectively; each of said input nodes of a given cell is connected via a respective branch diode to a respective one of said output nodes of the given cell, and via a respective shunt diode to a different respective output node of the given cell; and each output node of the given cell has connections from one only of the branch diodes of said cell and one only of the shunt diodes of said cell.

6. The lighting system according to claim 5, wherein, in each said cell, each input node terminal in an upper half of the structure, along with a corresponding input node terminal in the lower half of the structure, are connected to the same output node terminals.

7. The lighting system according to claim 5, wherein, in each said cell, each output node terminal in an upper half of the structure, along with a corresponding output node terminal in the lower half of the structure, are connected to the same input node terminals.

8. The lighting system according to claim 1, wherein said shunts each comprise a respective light-emitting diode.

9. The lighting system according to claim 1, wherein each said branch further comprises a respective current regulating element.

10. The lighting system according to claim 9, wherein said current regulating element is a respective resistor.

11. The lighting system according to claim 10, wherein each said branch comprises a series of elements, and for each said branch, said respective resistor is a first element of the series.

12. The lighting system according to claim 10, wherein each said branch comprises a series of elements, and for each said branch, said respective resistor is a last element of the series.

13. A method of lighting comprising the steps of: coupling in parallel a plurality of electrically-conductive branches;

forming at least two cells, wherein in each said cell, each said branch has a light-emitting diode having an anode terminal and a cathode terminal;

within each cell, coupling the anode terminal of each said light-emitting diode to the cathode terminal of a light-emitting diode of an adjacent branch via a shunt, wherein said branches along with said shunts are coupled to form a cascaded-cell lattice relationship; and providing power to said branches via a power supply.

14. The method according to claim 13, wherein said shunt coupling step further comprises coupling said anode terminal of a first light-emitting diode to a cathode terminal of a light-emitting diode which is $2^n$ branches away from said first light-emitting diode, wherein n is the cell.

15. The method according to claim 13, wherein said shunt coupling step further comprises coupling said anode terminal of a first light-emitting diode to a cathode terminal of a light-emitting diode which is $2^{n-1}$ branches away from said first light-emitting diode, wherein n is the cell.

16. The method according to claim 13, wherein said shunt coupling step further comprises coupling said anode terminal of a first light-emitting diode to a cathode terminal of a light-emitting diode which is $2^{N-n}$ branches away from said first light-emitting diode, wherein N is the number of said cells in said lighting system and n is a cell number.

17. The method according to claim 13, wherein said method further comprises coupling said anode terminals to N input node terminals and coupling said cathode terminals to N output node terminals, each said output node of a given cell being a said input node of a next cell of said cascaded-cell arrangement, respectively;

coupling each of said input nodes of a given cell via a respective branch diode to a respective one of said output nodes of the given cell, and via a respective shunt diode to a different respective output node of the given cell; and coupling each output node of the given cell to one only of the branch diodes of said cell and to one only of the shunt diodes of said cell.

18. The method according to claim 17, wherein said shunt coupling step further comprises coupling, in each said cell, each input node terminal in an upper half of the structure along with a corresponding input node terminal in a lower half of the structure to the same output node terminals.

19. The method according to claim 17, wherein said shunt coupling step further comprises coupling, in each said cell, each output node terminal in an upper half of the structure along with a corresponding output node terminal in a lower half of the structure to the same intput node terminals.

20. The method according to claim 13, wherein said method further comprises the step of coupling in each said shunt a light-emitting diode.

21. The method according to claim 13, wherein said method further comprises the step of coupling in each branch a current regulating element.

22. The method according to claim 21, wherein said step of coupling in each branch a current regulating element comprises coupling in each branch a respective resistor.

23. The method according to claim 22, wherein said step of coupling in each branch a respective resistor comprises forming each branch as a series of elements, and further comprises coupling said respective resistor as a first element in each said branch.

24. The method according to claim 22, wherein said step of coupling in each branch a respective resistor comprises forming each branch as a series of elements, and further comprises coupling said respective resistor as a first element in each said branch.

* * * * *